US010000871B2

(12) United States Patent
Komada et al.

(10) Patent No.: US 10,000,871 B2
(45) Date of Patent: Jun. 19, 2018

(54) SEWING MACHINE AND THREAD SPOOL DEVICE

(71) Applicant: BROTHER KOGYO KABUSHIKI KAISHA, Nagoya-shi, Aichi-ken (JP)

(72) Inventors: Midori Komada, Matsusaka (JP); Hironori Matsushita, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 390 days.

(21) Appl. No.: 14/846,542

(22) Filed: Sep. 4, 2015

(65) Prior Publication Data

US 2016/0083883 A1 Mar. 24, 2016

(30) Foreign Application Priority Data

Sep. 24, 2014 (JP) ..... 2014-194389

(51) Int. Cl.
*A41H 31/00* (2006.01)
*D05B 43/00* (2006.01)
*D05C 11/00* (2006.01)

(52) U.S. Cl.
CPC ..... *D05B 43/00* (2013.01); *D05C 11/00* (2013.01)

(58) Field of Classification Search
CPC ..... D05B 43/00; D05C 11/00
USPC ..... 223/106; 242/134
See application file for complete search history.

(56) References Cited

U.S. PATENT DOCUMENTS 1,521,636 A * 1/1925 Long ..... D05B 43/00 242/129.72
2,430,832 A * 11/1947 Smith ..... D05B 43/00 242/131
2,527,192 A * 10/1950 Mangiaracina ..... D05B 43/00 112/261
3,411,681 A * 11/1968 Bergman ..... D05B 43/00 225/38
3,987,978 A * 10/1976 Alberelli ..... B65H 49/26 242/134
4,441,666 A * 4/1984 Tower ..... B65H 49/18 242/134
5,913,485 A * 6/1999 Bruffett ..... B65H 49/32 112/302

(Continued)

FOREIGN PATENT DOCUMENTS

JP S61-188573 U 11/1986
JP H08-71278 A 3/1996

(Continued)

*Primary Examiner* — Nathan Durham
(74) *Attorney, Agent, or Firm* — Oliff PLC

(57) ABSTRACT

A sewing machine includes a first thread spool base having a first thread spool pin and a first guide member, and a second thread spool base having a second thread spool pin and a second guide member. The first thread spool pin is inserted into a through hole of a thread spool. The first guide member has a first thread guard portion that guides a needle thread delivered from a thread spool mounted on the first thread spool base to the sewing machine. The second thread spool base can be attached to and removed from the first thread spool base. The second thread spool pin is inserted into a through hole of the thread spool. The second guide member has a second thread guard portion that guides a needle thread delivered from the thread spool mounted on the second thread spool base to the sewing machine.

15 Claims, 16 Drawing Sheets

(56) References Cited

U.S. PATENT DOCUMENTS

| | | | | |
|---|---|---|---|---|
| 6,729,252 | B2 * | 5/2004 | Wada | D05B 19/085 112/278 |
| 7,114,455 | B2 | 10/2006 | Prufer et al. | |
| 2007/0227421 | A1 * | 10/2007 | Nomura | B65H 49/04 112/2 |
| 2012/0012043 | A1 * | 1/2012 | Fujihara | B65H 49/16 112/302 |

FOREIGN PATENT DOCUMENTS

| | | | |
|---|---|---|---|
| JP | H08-98977 | A | 4/1996 |
| JP | 2000-024356 | A | 1/2000 |
| JP | 2000-126487 | A | 5/2000 |
| JP | 2000-126488 | A | 5/2000 |

* cited by examiner

SEWING MACHINE AND THREAD SPOOL DEVICE

CROSS-REFERENCE TO RELATED APPLICATION

This application claims priority to Japanese Patent Application No. 2014-194389 filed Sep. 24, 2014, the content of which is hereby incorporated herein by reference.

BACKGROUND

The present disclosure relates to a sewing machine provided with a thread spool base on which a thread spool can be mounted and to a thread spool device.

A thread spool base has been conventionally known on which a plurality of thread spools, around which a needle thread is wound, can be mounted, the needle thread being supplied to a sewing needle of a sewing machine. For example, a thread spool device has been known in which five thread spool pins are fixed on the thread spool base so that up to five thread spools can be mounted on the thread spool base. In this manner, on the thread spool base of the conventional thread spool device, a plurality of thread spool pins are provided in advance so as to be able to accommodate the number of thread spools to be mounted that respectively correspond to types of the needle thread to be used in a sewing operation performed by the sewing machine.

SUMMARY

However, the size of the above-described thread spool device is larger than necessary, for example, for a user who only uses one or two types of the needle thread, as more than a necessary number of thread spools can be mounted on the thread spool device. As a result, it is necessary for the user to secure an extra space around the sewing machine in order to arrange the thread spool device.

It is an object of the present disclosure to provide a sewing machine that can combine a plurality of small thread spool bases, on each of which a small number of thread spools can be mounted according to the needs of the user, and a thread spool device.

A sewing machine according to a first aspect of the present disclosure includes a first thread spool base, a first thread spool pin, a first guide member, a second thread spool base, a second thread spool pin, and a second guide member. The first thread spool base is configured such that a thread spool is mounted thereon. The first thread spool pin is provided on the first thread spool base and is configured to be inserted into a through hole of the thread spool mounted on the first thread spool base. The first guide member is provided in the first thread spool base and has a first thread guard portion. The first thread guard portion is configured to guide a needle thread delivered from the thread spool mounted on the first thread spool base to the sewing machine. The second thread spool base is configured to be capable of being attached to and removed from the first thread spool base and is configured such that a thread spool is mounted thereon. The second thread spool pin is provided on the second thread spool base and is configured to be inserted into a through hole of the thread spool mounted on the second thread spool base. The second guide member has a second thread guard portion. The second thread guard portion is configured to guide a needle thread delivered from the thread spool mounted on the second thread spool base to the sewing machine.

A thread spool device according to a second aspect of the present disclosure includes a first thread spool base, a first thread spool pin, a first guide member, a second thread spool base, a second thread spool pin, and a second guide member. The first thread spool base is configured such that a thread spool is mounted thereon. The first thread spool pin is provided on the first thread spool base and is configured to be inserted into a through hole of the thread spool mounted on the first thread spool base. The first guide member is provided in the first thread spool base and has a first thread guard portion. The first thread guard portion is configured to guide a needle thread delivered from the thread spool mounted on the first thread spool base to the sewing machine. The second thread spool base is configured to be capable of being attached to and removed from the first thread spool base and is configured such that a thread spool is mounted thereon. The second thread spool pin is provided on the second thread spool base and is configured to be inserted into a through hole of the thread spool mounted on the second thread spool base. The second guide member has a second thread guard portion. The second thread guard portion is configured to guide a needle thread delivered from the thread spool mounted on the second thread spool base to the sewing machine.

BRIEF DESCRIPTION OF THE DRAWINGS

Embodiments will be described below in detail with reference to the accompanying drawings in which.

DETAILED DESCRIPTION

An embodiment of the present disclosure will be described below with reference to the drawings. First, a configuration of a sewing machine 1 will be described. In the description below, an upper side, a lower side, a lower left side, an upper right side, an upper left side, and a lower right side in FIG. 1 are respectively defined as an upper side, a lower side, a front side, a rear side, a left side, and a right side of the sewing machine 1.

Figure 1:
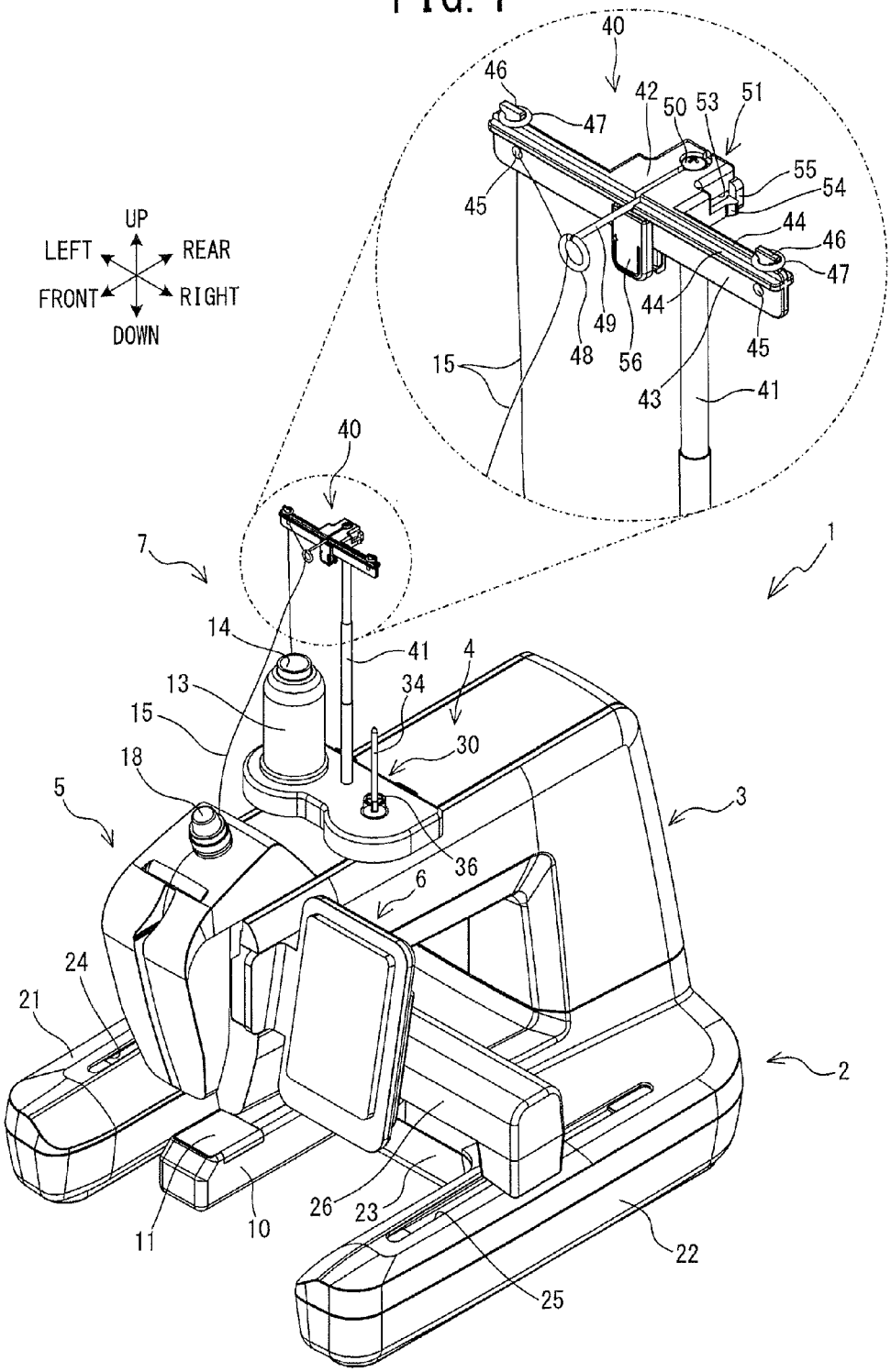
FIG. 1 is a perspective view of a sewing machine 1.

As shown in FIG. 1, the sewing machine 1 is mainly provided with a support portion 2, a pillar 3, and an arm portion 4. The support portion 2 is a base portion of the sewing machine 1 and supports the sewing machine 1 as a whole. The support portion 2 is formed overall in a U-shape in a plan view. The support portion 2 is provided with a pair of leg portions 21 and 22 and a base portion 23. The pair of leg portions 21 and 22 respectively extend in the front-rear direction and are disposed side by side in the left-right direction. The base portion 23 is disposed on a rear side of each of the leg portions 21 and 22 and between the leg portion 21 and the leg portion 22. The base portion 23 extends in the left-right direction and connects the leg portion 21 and the leg portion 22.

The base portion 23 is provided with a cylindrical cylinder head 10, which extends forward, at a substantially central section of the base portion 23 in the left-right direction. A work cloth (not shown in the drawings) is arranged on an upper surface of the cylinder head 10. A shuttle mechanism (not shown in the drawings) is provided inside the cylinder head 10. The shuttle mechanism drives a shuttle (not shown in the drawings) to rotate, the shuttle being arranged in the interior of a leading end of the cylinder head 10. The shuttle stores a bobbin (not shown in the drawings) around which a bobbin thread (not shown in the drawings) is wound. A needle plate 11 having a rectangular shape in a plan view is provided on the upper surface of the leading end of the cylinder head 10. The needle plate 11 is disposed above the shuttle. A needle hole (not shown in the drawings) is formed in the needle plate 11. A sewing needle (not shown in the drawings), which is attached to a lower end of a needle bar (to be described later), is inserted through the needle hole of the needle plate 11.

Guide grooves 24 and 25 that extend in the front-rear direction are respectively formed on upper surfaces of the leg portions 21 and 22. The guide grooves 24 and 25 guide a movement in the front-rear direction of a carriage 26. The carriage 26 extends in the left-right direction and is mounted between the pair of leg portions 21 and 22. A movement mechanism (not shown in the drawings) is provided inside the carriage 26. An embroidery frame (not shown in the drawings) that holds the work cloth can be attached to the movement mechanism. The movement mechanism causes the embroidery frame to move in the left-right direction. The sewing machine 1 causes the embroidery frame to move in the front-rear and left-right directions by causing the carriage 26 to move in the front-rear direction (in other words, by causing the movement mechanism to move as a whole in the front-rear direction) and by using the movement mechanism to cause the embroidery frame to move in the left-right direction.

The pillar 3 is provided in a rear end of the base portion 23 and extends upward. The arm portion 4 extends from an upper end of the pillar 3 toward the front side while facing the cylinder head 10. A thread spool portion 7 is provided on an upper surface of the arm portion 4. On the thread spool portion 7, a plurality of thread spools 13, around each of which a needle thread 15 is wound, are mounted. The thread spool portion 7 will be described later.

A leading end of the arm portion 4 is a head portion 5. The head portion 5 is provided with a tensioner 18, the needle bar (not shown in the drawings), a needle bar driving mechanism (not shown in the drawings), a thread take-up lever mechanism (not shown in the drawings), etc. The tensioner 18 is provided on an upper portion of the head portion 5, and applies a tension to the needle thread 15 supplied from the thread spool portion 7. The needle bar extends downward from the lower end of the head portion 5. The sewing needle (not shown in the drawings) can be attached to the lower end of the needle bar. An eye (not shown in the drawings), through which the needle thread is inserted, is provided in the sewing needle. The needle bar driving mechanism causes the needle bar to move up and down. The thread take-up lever mechanism causes a thread take-up lever (not shown in the drawings) to move up and down in synchronization with the upward and downward movement of the needle bar. At the time of sewing, the needle bar (the sewing needle) operates together with the shuttle, and causes the needle thread 15 to be interlaced with the bobbin thread pulled out from the bobbin stored in the shuttle. The thread take-up lever pulls up the needle thread 15 interlaced with the bobbin thread above the needle plate 11.

An operation portion 6 is provided on a right side of the head portion 5. The operation portion 6 is provided with a liquid crystal display, a touch panel, a start/stop switch, etc. The liquid crystal display displays various types of information, such as an operation screen on which a user inputs instructions, for example. The touch panel accepts the instructions from the user. The start/stop switch gives instructions to start or stop the sewing operation.

Figure 2:
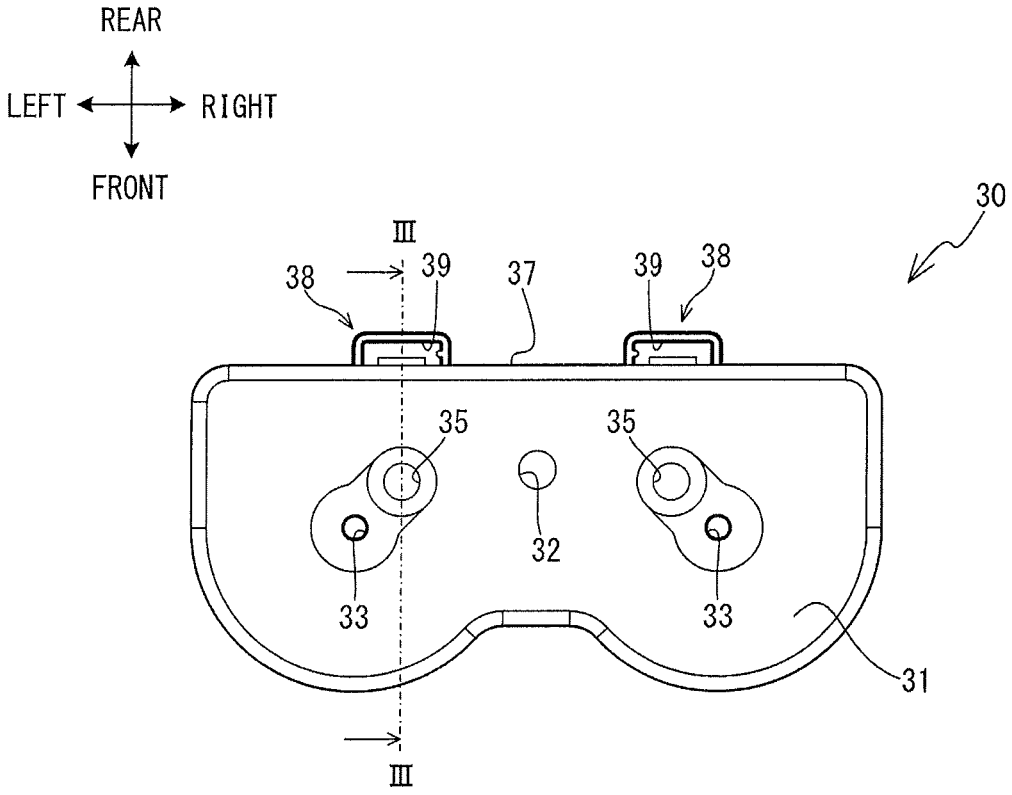
FIG. 2 is a plan view of a thread spool base 30.
Figure 3:
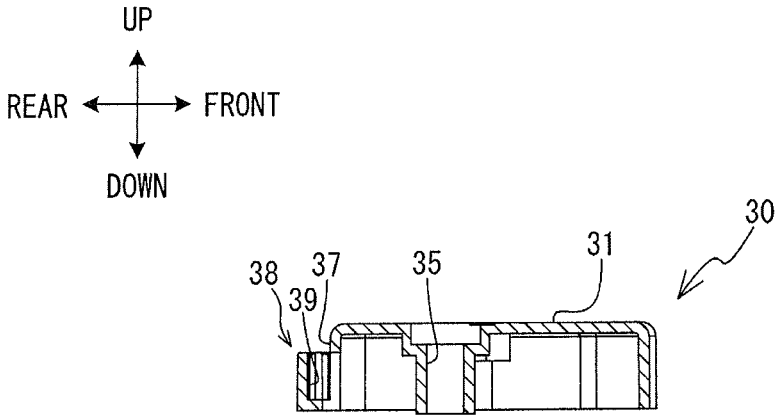
FIG. 3 is a cross-sectional view of the thread spool base 30 when viewed in a direction of arrows along an alternate long and short dash line in FIG. 2.

Next, the thread spool portion 7 will be described with respect to FIG. 1 to FIG. 5. The thread spool portion 7 is provided with a thread spool base 30 and a guide member 40. As shown in FIG. 1 to FIG. 3, the thread spool base 30 has a box-shape that has an open lower portion. The thread spool base 30 is longer in the left-right direction than in the front-rear direction and is thick in the up-down direction. The thread spool base 30 has left and right edge portions on the front side thereof in a plan view, the edge portions respectively protruding toward the front side while forming an arc shape. Corner portions of the thread spool base 30 are all chamfered. A support pillar hole 32 is formed in a central section, in the left-right direction, and in a substantially central section, in the front-rear direction, of an upper surface 31 of the thread spool base 30. A lower end of a support pillar 41 (which will be described later) of the guide member 40 is inserted into the support pillar hole 32.

Thread spool pin holes 33 are formed in the upper surface 31 of the thread spool base 30, at a position to the left and to the front of the support pillar hole 32 and at a position to the right and to the front of the support pillar hole 32, respectively. Each of the two thread spool pin holes 33 is provided at a central position of an arc that corresponds to the arc-shaped protruding portion of the upper surface 31. Lower ends of two thread spool pins 34 (see FIG. 1) are respectively fitted into the two thread spool pin holes 33 and are fixed therein. Each of the two thread spool pins 34 extends upward from the thread spool base 30, and an upper end of the thread spool pin 34 is formed in a tapered shape. The thread spool pin 34 is inserted into a through hole 14 of the thread spool 13. Note that a state in which the left thread spool pin (not visible in the drawing) is inserted into the through hole 14 of the thread spool 13 is illustrated in FIG. 1. In this manner, the thread spool 13 is mounted on the upper surface 31 of the thread spool base 30 in a state in which the thread spool 13 is standing, more specifically, in a state in which a center line of the through hole 14 is aligned along the up-down direction. Further, a pair of fixing holes 35 are formed in the upper surface 31 of the thread spool base 30 at positions respectively located between each of the two thread spool pin holes 33 and the support pillar hole 32. A fixing screw 36 (see FIG. 1) is inserted into each of the pair of fixing holes 35. A screw hole (not shown in the drawings) is provided in the upper surface of the arm portion 4. The thread spool base 30 is fixed on the arm portion 4 as a result of the fixing screw 36 being fastened into the screw hole.

As shown in FIG. 2 and FIG. 3, a pair of engaging portions 38, which protrude toward the rear side, are provided on a rear surface 37 of the thread spool base 30. The pair of engaging portions 38 are positioned to the rear of the pair of fixing holes 35 in a plan view, respectively. A hole portion 39 that has an open upper portion is formed in each of the pair of engaging portions 38. The engaging portion 38 that is provided with the hole portion 39 is formed in a pocket-shape. The rear surface 37 opens downward at positions in which the hole portions 39 are formed. The engaging portions 38 engage with engaging portions 68 of a thread spool base 60, which will be described later, and can connect the thread spool base 30 and the thread spool base 60.

Figure 4:
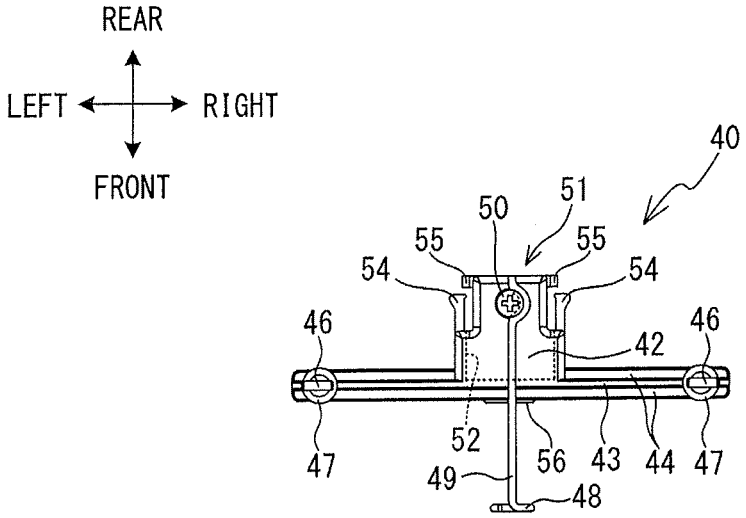
FIG. 4 is a plan view of a guide member 40.
Figure 5:
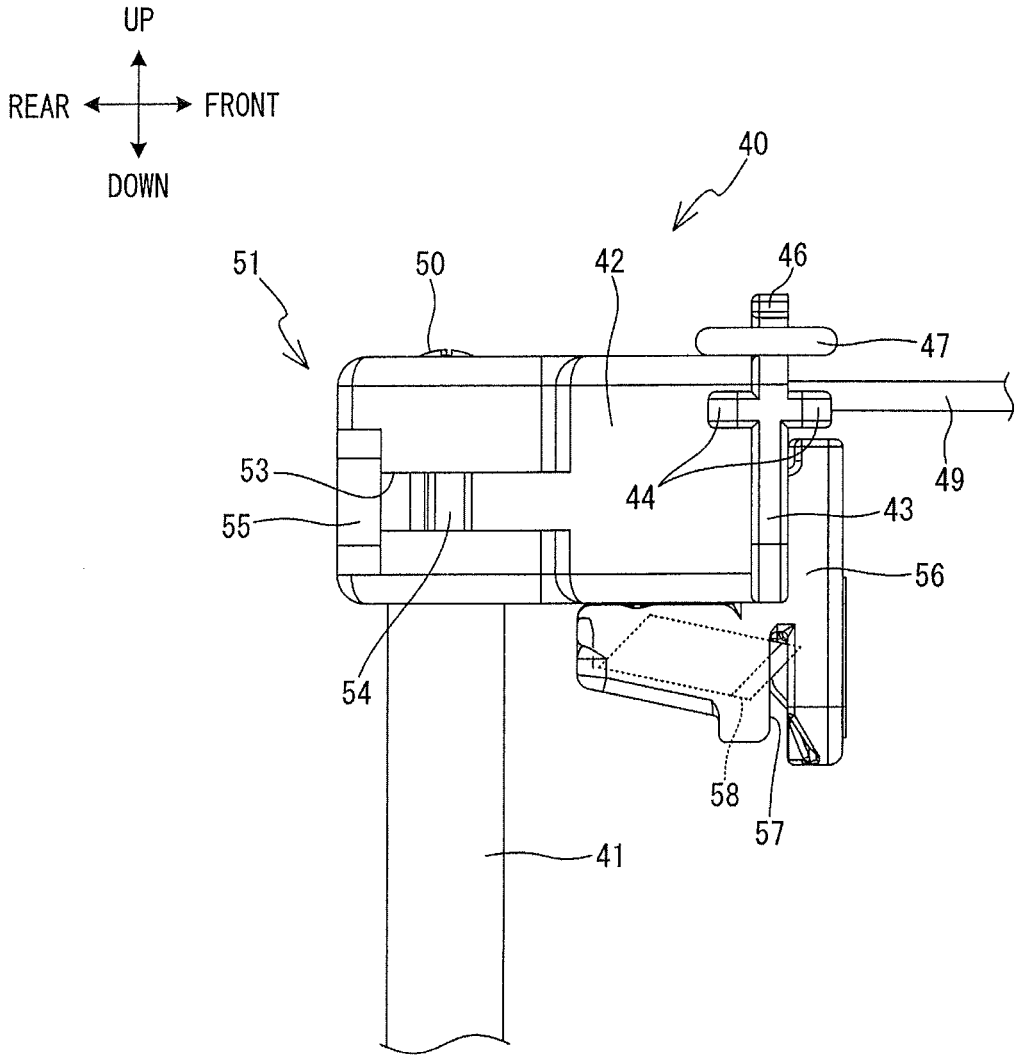
FIG. 5 is a view of a left-side surface of the guide member 40.

As shown in FIG. 1, FIG. 4, and FIG. 5, the guide member 40 is provided with the support pillar 41, an arm support 42, a guide arm 43, thread guard holes 45, O-rings 47, a threading member 49, and a cutting member 56. The support pillar 41 is used to dispose the thread guard holes 45, which are provided in the guide arm 43, above the thread spool base 30. The support pillar 41 is a bar that extends in the up-down direction. As described above, a lower end of the support pillar 41 is inserted into the support pillar hole 32 of the thread spool base 30 (see FIG. 2), and the support pillar 41 is thereby fixed to the thread spool base 30. The arm support 42 is fixed to an upper end of the support pillar 41. The arm support 42 has a substantially rectangular shape, and the guide arm 43 is provided in a front portion of the arm support 42. The arm support 42 and the guide arm 43 are integrally formed.

The guide arm 43 has a plate shape that is long in the left-right direction. A thickness direction of the guide arm 43 is arranged in the front-rear direction. A length of the guide arm 43 in the left-right direction is longer than a length between the two thread spool pins 34 and shorter than a length of the thread spool base 30 in the left-right direction. A length of the guide arm 43 in the up-down direction is similar to a length of the arm support 42 in the up-down direction. The guide arm 43 has a flange portion 44 that is positioned further to the upper side than a central position of the guide arm 43 in the up-down direction. The flange portion 44 protrudes on the front and rear sides of the guide arm 43, respectively, and is formed so as to have a similar length to that of the guide arm 43 in the left-right direction. The flange portion 44 functions as a reinforcing rib of the guide arm 43. In both left and right ends of the guide arm 43, the thread guard holes 45 that penetrate through in the thickness direction are formed, respectively. The needle thread 15 passes through the thread guard hole 45 along a pathway through which the needle thread 15, which is delivered from the thread spool 13, is guided to the tensioner 18. The two thread guard holes 45 are provided so as to correspond to the two thread spool pins 34, respectively.

Protruding portions 46 are respectively provided above the two thread guard holes 45, the protruding portions 46 protruding upward from an upper surface at the left and right ends of the guide arm 43. Each of the protruding portions 46 is formed in a substantially T-shape with a base end side thereof formed to be narrower than a leading end side thereof. The rubber O-ring 47 is fitted to the narrowed section of each of the protruding portions 46. A lower surface of the O-ring 47 is maintained, by the protruding portion 46, in a state of being in contact with the upper surface of the guide arm 43. When the needle thread 15 is inserted into a section between the lower surface of the O-ring 47 and the upper surface of the guide arm 43, the O-ring 47 elastically deforms slightly. Due to the elasticity of the O-ring 47, the O-ring 47 can sandwich and hold the needle thread 15, with a relatively weak force, between the lower surface of the O-ring 47 and the upper surface of the guide arm 43.

The threading member 49 is provided in an upper portion of the arm support 42. The threading member 49 is a wire rod having a round-shaped cross-section. A circular portion 48 that is bent into a circular shape is formed at a front end of the threading member 49. A rear end of the threading member 49 is fixed by a screw 50 to a rear end of the upper portion of the arm support 42. In this manner, the circular portion 48 is disposed so as to protrude forward from the guide arm 43. An upper portion of the circular portion 48 is open slightly, and the needle thread 15 can be caused to pass through the opening. The needle thread 15, which is delivered from the thread spool 13 and caused to pass through the thread guard hole 45, is caused to pass through the circular portion 48 and guided to the tensioner 18.

A hole portion 52 (see FIG. 4), which has an open rear portion, is formed inside the arm support 42. In a plan view, a rear section of the arm support 42 is shorter in the left-right direction than a front section of the arm support 42, the rear section being located further to the rear side from a central position of the arm support 42 in the front-rear direction. Slits 53 are formed respectively in both left and right side wall portions of the arm support 42 so as to extend in the front-rear direction. Each of the slits 53 is provided in the rear section located further to the rear side from the central position of the arm support 42 in the front-rear direction and is connected to the opening in the rear section of the arm support 42. Locking pieces 55 that each bridge the slit 53 in the up-down direction are provided in a rear end portion of each of the slits 53. The left locking piece 55 protrudes to the left side from the left side wall portion of the arm support 42. The right locking piece 55 protrudes to the right side from the right side wall portion of the arm support 42. In both left and right rear ends of the rear section located further to the rear side from a central position of the arm support 42 in the front-rear direction, flexible arms 54 that extend to the rear side are provided. A gap is provided respectively between the left and right flexible arms 54 and the left and right slits 53. A rear end of each of the flexible arms 54 is located further to the front side than the locking piece 55. An engaging portion 51 is configured by the hole portion 52, the slits 53, the locking pieces 55, and the flexible arms 54. The engaging portion 51 engages with an engaging portion 81 of a guide member 70, which will be described later, and can connect the guide member 40 and the guide member 70.

The cutting member 56 is provided in a front lower portion of the arm support 42. As shown in FIG. 5, a slit portion 57 is provided in a lower portion of the cutting member 56. The slit portion 57 is formed in a notch shape that extends upward from a lower end of the cutting member 56 and penetrates through the cutting member 56 in the left-right direction. A cutting blade 58 is provided inside the cutting member 56. An edge of the cutting blade 58 is disposed inside the slit portion 57. The cutting blade 58 can cut the needle thread 15 that is inserted into the slit portion 57.

Figure 6:
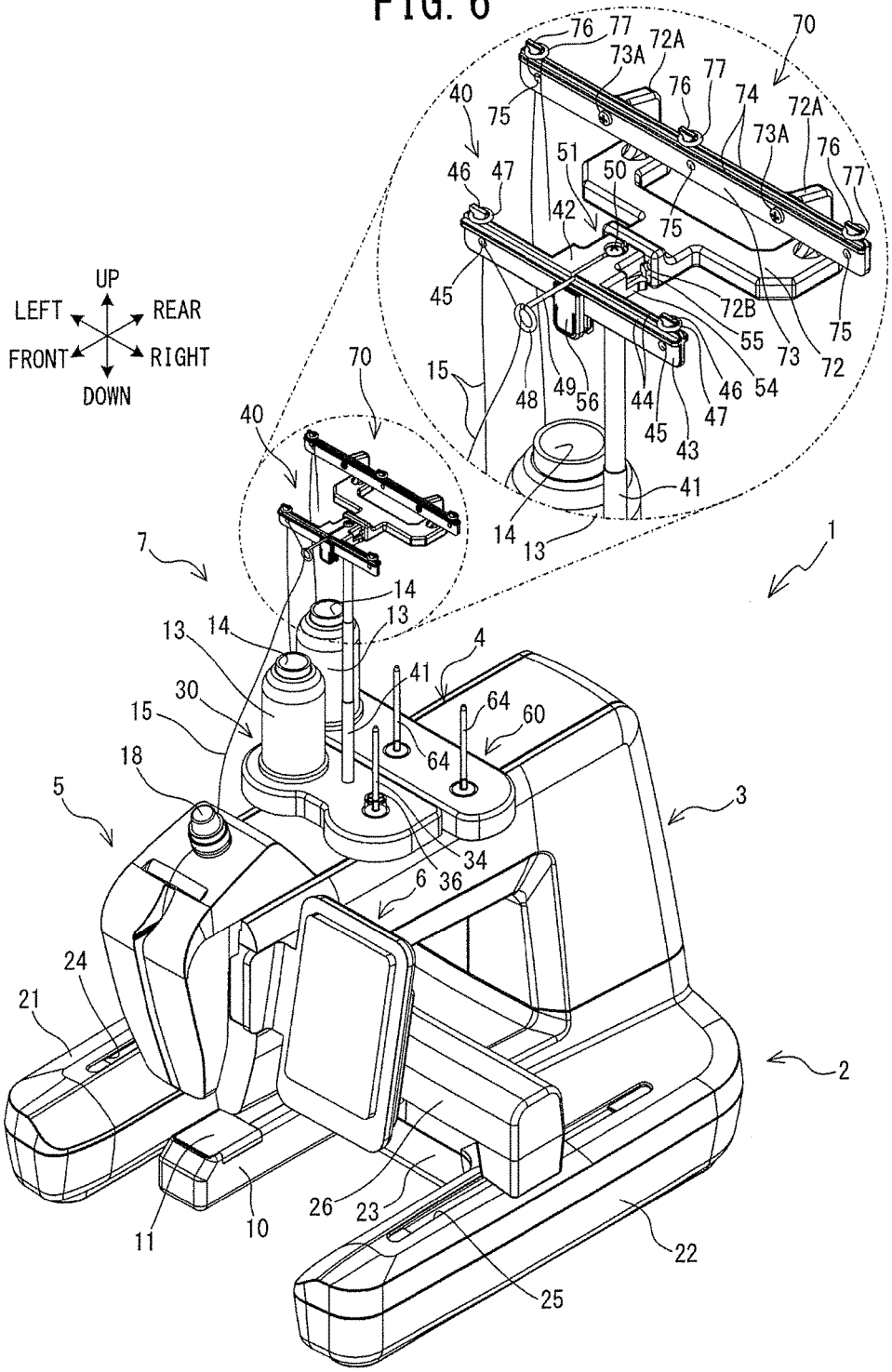
FIG. 6 is a perspective view of the sewing machine 1 on which a thread spool base 60 is mounted.

As shown in FIG. 6, the thread spool portion 7 of the sewing machine 1 having the above-described configuration can connect the thread spool base 60 to the thread spool base 30 and also can connect the guide member 70 to the guide member 40. With this configuration, the thread spool portion 7 can increase the number of thread spools 13 to be mounted. As shown in FIG. 6 to FIG. 9, the thread spool base 60 has a box-shape having an open lower portion. The thread spool base 60 is longer in the left-right direction than in the front-rear direction and is thick in the up-down direction. A length of the thread spool base 60 in the left-right direction is longer than that of the thread spool base 30 in the left-right direction. Both left and right edge portions of the thread spool base 60 in a plan view are formed in an arc shape, respectively. Corner portions of the thread spool base 60 are all chamfered.

Three thread spool pin holes 63 are formed in an upper surface 61 of the thread spool base 60. The thread spool pin holes 63 are arranged in a row in the left-right direction. Each of the left and right thread spool pin holes 63 is provided in a central position of an arc that corresponds to the arc-shaped portion of the upper surface 61. The central thread spool pin hole 63 is provided in a central position between the left and right thread spool pin holes 63. Lower ends of three thread spool pins 64 (see FIG. 6) are respectively fitted into the three thread spool pin holes 63 and are fixed therein. Each of the three thread spool pins 64 extends upward from the thread spool base 60, and an upper end of the thread spool pin 64 is formed in a tapered shape. Similarly to the thread spool base 30, in the thread spool base 60, the thread spool pin 64 is inserted into the through hole 14 of the thread spool 13, and the thread spool 13 is mounted in a standing state. Note that a state is shown in FIG. 6 in which the left thread spool pin (not visible in the drawings) is inserted into the through hole 14 of the thread spool 13. The thread spool base 60 is provided with a protruding portion 65 (see FIG. 8), which protrudes downward, in a position on the rear side of the central thread spool pin hole 63 in a plan view. A leading end of the protruding portion 65 protrudes from a lower end of the thread spool base 60. An engaging hole (not shown in the drawings) is provided in the upper surface of the arm portion 4. When the thread spool base 60 is connected to the thread spool base 30, the tip end of the protruding portion 65 is inserted into the engaging hole, and the positioning of the thread spool base 60 with respect to the arm portion 4 is determined.

Figure 7:
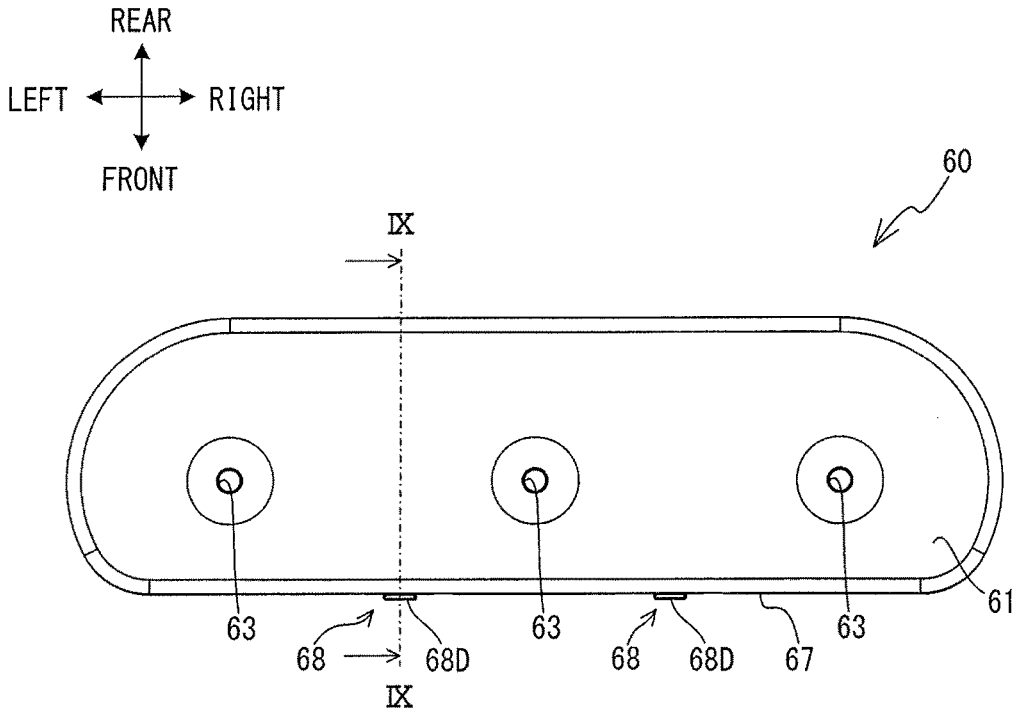
FIG. 7 is a plan view of the thread spool base 60.
Figure 8:
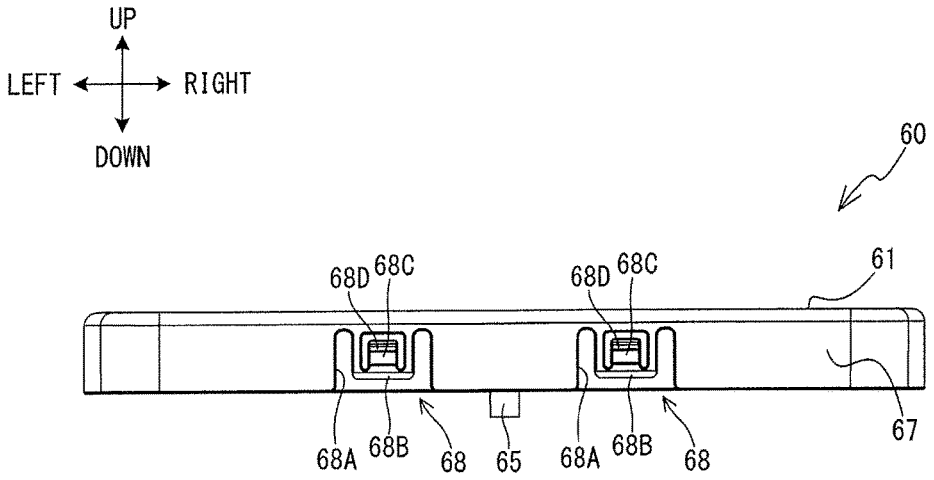
FIG. 8 is a front view of the thread spool base 60.
Figure 9:
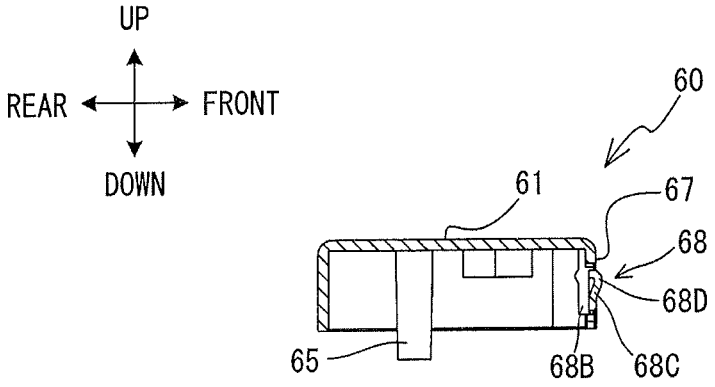
FIG. 9 is a cross-sectional view of the thread spool base 60 when viewed in a direction of arrows along an alternate long and short dash line IX-IX in FIG. 7.

As shown in FIG. 7 to FIG. 9, a pair of engaging portions 68 are provided on a front surface 67 of the thread spool base 60. When the thread spool base 30 and the thread spool base 60 are connected together, the engaging portions 68 are engaged with the engaging portions 38. The pair of engaging portions 68 are respectively positioned between the three thread spool pin holes 63 in a plan view. The pair of engaging portions 68 are provided so as to have a substantially identical gap therebetween as the gap between the pair of engaging portions 38 of the thread spool base 30 in the left-right direction. A concave portion 68A and a protruding portion 68B are formed in each of the pair of engaging portions 68. The concave portion 68A is formed by causing a front wall portion of the thread spool base 60 to be cut off at the lower end thereof. More specifically, the concave portion 68A has a substantially U-shape in a front view, and a lower end side thereof is open to a bottom surface of the thread spool base 60. The protruding portion 68B protrudes downward from an upper end of the concave portion 68A inside the concave portion 68A. Both left and right ends of the protruding portion 68B protrude to the rear side. The protruding portion 68B has a rib structure that extends in the up-down direction. A size of the protruding portion 68B in the left-right direction is slightly smaller than that of the hole portion 39 of the engaging portion 38 of the thread spool base 30 in the left-right direction. A latch portion 68C is formed inside the protruding portion 68B. The latch portion 68C is formed by causing the inside of the protruding portion 68B to be cut away in a substantially reverse U-shape in a front view. A lower end of the latch portion 68C is fixed to the protruding portion 68B, and an upper end thereof can bend in the front-rear direction. A bulging portion 68D that bulges further to the front side than the front surface 67 is provided at the upper end of the latch portion 68C.

Figure 10:
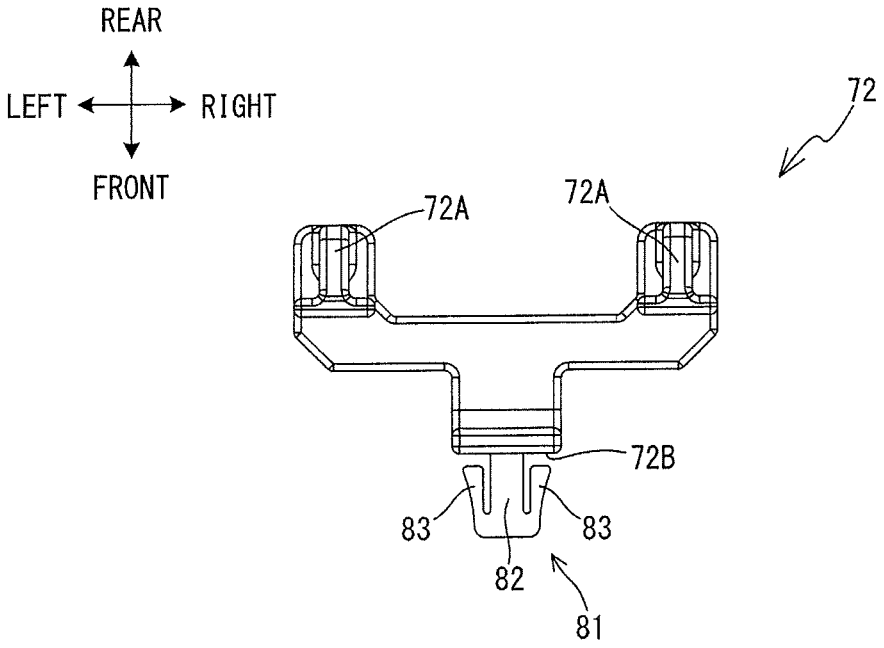
FIG. 10 is a plan view of a guide member 70.

As shown in FIG. 6, the guide member 70 is provided with an arm support 72, a guide arm 73, thread guard holes 75, and O-rings 77. As shown in FIG. 6 and FIG. 10, the arm support 72 has a plate-shape with a thickness, and a rear side of the arm support 72 is forked in two so as to form a substantially Y-shape in a plan view. The engaging portion 81 is provided at a front end of the arm support 72. Details of the engaging portion 81 will be described later. A pair of arm support portions 72A, which protrude upward, are respectively provided at both ends of the forked portion of the arm support 72.

As shown in FIG. 6, the pair of arm support portions 72A respectively extend upward and forward, and the guide arm 73 is fixed to tip ends of the arm support portions 72A. The guide arm 73 has a plate-shape similarly to the guide arm 43, and the guide arm 73 extends longer in the left-right direction than the guide arm 43. A length of the guide arm 73 in the left-right direction is longer than that of a section between the left- and right-end thread spool pins 64 and shorter than that of the thread spool base 60 in the left-right direction. The guide arm 73 is fixed to the respective tip ends of the pair of arm support portions 72A by screws 73A. Similarly to the guide arm 43, the guide arm 73 also has a flange portion 74 that functions as a reinforcing rib. The three thread guard holes 75 that penetrate through the guide arm 73 in the thickness direction are respectively formed in both left and right ends and in a central section of the guide arm 73. The needle thread 15 passes through the thread guard hole 75 along a pathway through which the needle thread 15, which is delivered from the thread spool 13 mounted on the thread spool base 60, is guided to the tensioner 18. The three thread guard holes 75 are provided so as to correspond to the three thread spool pins 64, respectively. Note that a shape of the forked portion of the arm support 72 is a shape that does not come into contact with the needle thread 15 even when the needle thread 15, which is delivered from the thread spool 13 mounted on the thread spool base 60, reaches the thread guard hole 75 positioned substantially directly above the thread spool 13.

Protruding portions 76 are respectively provided above the three thread guard holes 75, the protruding portions 76 protruding upward from an upper surface at the left and right ends and the central section of the guide arm 73. Similarly to the protruding portion 46, each of the protruding portions 76 is formed in a substantially T-shape. The rubber O-ring 77 is fitted to a section between the upper surface of the guide arm 73 and each of the protruding portions 76. Similarly to the effect of the O-ring 47, the O-ring 77 can sandwich and hold the needle thread 15, with a relatively weak force, between a lower surface of the O-ring 77 and the upper surface of the guide arm 73.

An upper surface of a front end of the arm support 72 bulges upward so as to form a large front surface 72B. As shown in FIG. 10, the engaging portion 81 that engages with the engaging portion 51 of the arm support 42 is formed in the front surface 72B of the arm support 72. The engaging portion 81 has a plate-shape with a thickness and protrudes forward. The engaging portion 81 is provided with a support protrusion 82 and a pair of spring pieces 83. The support protrusion 82 protrudes forward from a substantially central section of the front surface 72B. The pair of spring pieces 83 extend rearward by being folded back from both left and right ends of a front end of the support protrusion 82, respectively. Rear ends of the pair of spring pieces 83 are arranged so as to spread out wider in the left-right direction than the left and right ends of the front end of the support protrusion 82 in a plan view, respectively. The rear ends of the spring pieces 83 can bend in the left-right direction and can come close to and separate further from the support protrusion 82. A thickness of the spring piece 83 in the up-down direction is slightly smaller than a width of the slit 53 of the engaging portion 51 in the up-down direction.

Figure 11:
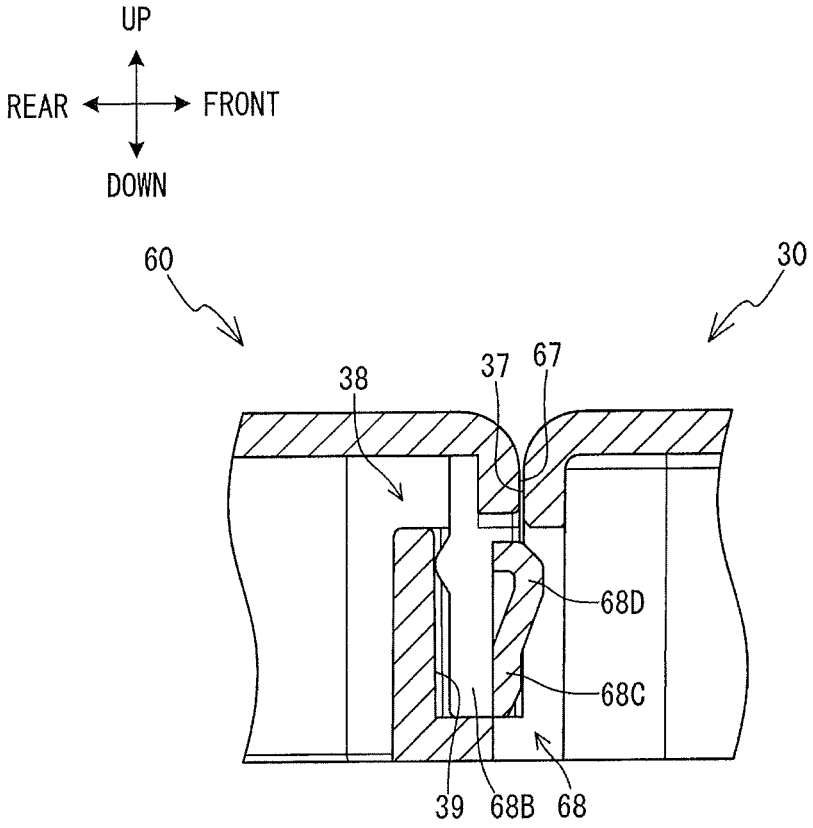
FIG. 11 is a cross-sectional view illustrating an engaged state between an engaging portion 38 of the thread spool base 30 and an engaging portion 68 of the thread spool base 60.

When the thread spool base 60 having the above-described configuration is connected to the thread spool base 30, the thread spool base 60 is disposed on an upper side of a rear portion of the thread spool base 30 in a state in which the engaging portions 68 face the front side. The protruding portion 65 of the thread spool base 60 is disposed directly above the engaging hole (not shown in the drawings) provided in the upper surface of the arm portion 4. As shown in FIG. 3 and FIG. 9, when the thread spool base 60 is moved downward, the protruding portion 65 of the thread spool base 60 is inserted into the engaging hole in the upper surface of the arm portion 4. A positioning of the thread spool base 60 is determined with respect to the thread spool base 30, and the protruding portions 68B of the engaging portions 68 are inserted into the hole portions 39 of the engaging portions 38. In the insertion process, when the bulging portion 68D abuts against the rear surface 37 of the thread spool base 30, an upper end of the latch portion 68C bends to the rear side. As shown in FIG. 11, when the latch portion 68C is further inserted into the hole portion 39, the bulging portion 68D is positioned below a bottom surface of a rear wall of the thread spool base 30 inside the hole portion 39, and the abutting state between the bulging portion 68D and the rear surface 37 is released. At this time, the bent upper end of the latch portion 68C returns to its original state. The bulging portion 68D is disposed further to the front side than the rear surface 37. In this manner, the engaging portions 38 and the engaging portions 68 obtain a mutually engaged state. Using at least its own weight, the thread spool base 60 can maintain a state in which the latch portion 68C is inserted into the hole portion 39. In this state, even when a force that causes the latch portion 68C to move upward with respect to the hole portion 39 is applied by some form of external force, for example, the bottom surface of the rear wall of the thread spool base 30 abuts against the bulging portion 68D inside the hole portion 39, thereby inhibiting the latch portion 68C from becoming dislodged. In this manner, as long as the upper end of the latch portion 68C does not bend, the engaging portions 38 and the engaging portions 68 can maintain the mutually engaged state.

Figure 12:
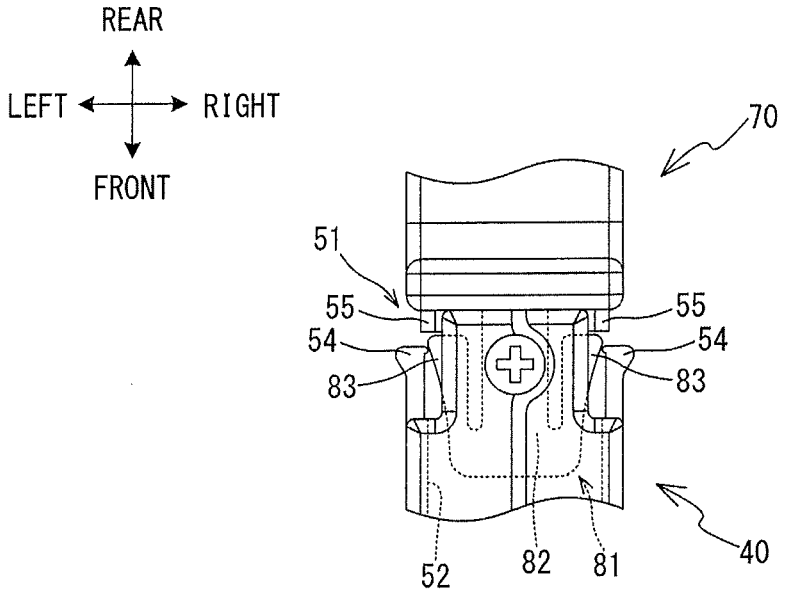
FIG. 12 is a plan view illustrating an engaged state between an engaging portion 51 of the guide member 40 and an engaging portion 81 of the guide member 70.

When the guide member 70 is connected to the guide member 40, the guide member 70 is disposed on the rear side of the guide member 40. As shown in FIG. 4 and FIG. 10, when the guide member 70 is caused to move forward, the support protrusion 82 of the engaging portion 81 is inserted into the hole portion 52 of the engaging portion 51. Side surfaces of the pair of spring pieces 83 of the engaging portion 81 abut against the pair of locking pieces 55 of the engaging portion 51 and the respective rear ends of the spring pieces 83 are bent toward the support protrusion 82 side. As shown in FIG. 12, when the support protrusion 82 is further inserted into the hole portion 52, rear end surfaces of the spring pieces 83 are positioned further to the front side than the locking pieces 55, and the abutting state between the spring pieces 83 and the locking piece 55 is released. At this time, the bent rear ends of the spring pieces 83 return to their original state. The rear ends of the spring pieces 83 protrude to the outside of the hole portions 52 from the slits 53 (see FIG. 5). The rear end surfaces of the spring pieces 83 face front surfaces of the locking pieces 55. In this manner, the engaging portion 51 and the engaging portion 81 obtain a mutually engaged state. In this state, even when a force that causes the support protrusion 82 to move rearward with respect to the hole portion 52 is applied by some form of external force, for example, the front surfaces of the locking pieces 55 abut against the rear end surfaces of the spring pieces 83, thereby inhibiting the spring pieces 83 from becoming dislodged. In this manner, as long as the spring pieces 83 do not bend, the engaging portions 51 and the engaging portions 81 can maintain the mutually engaged state.

Figure 13:
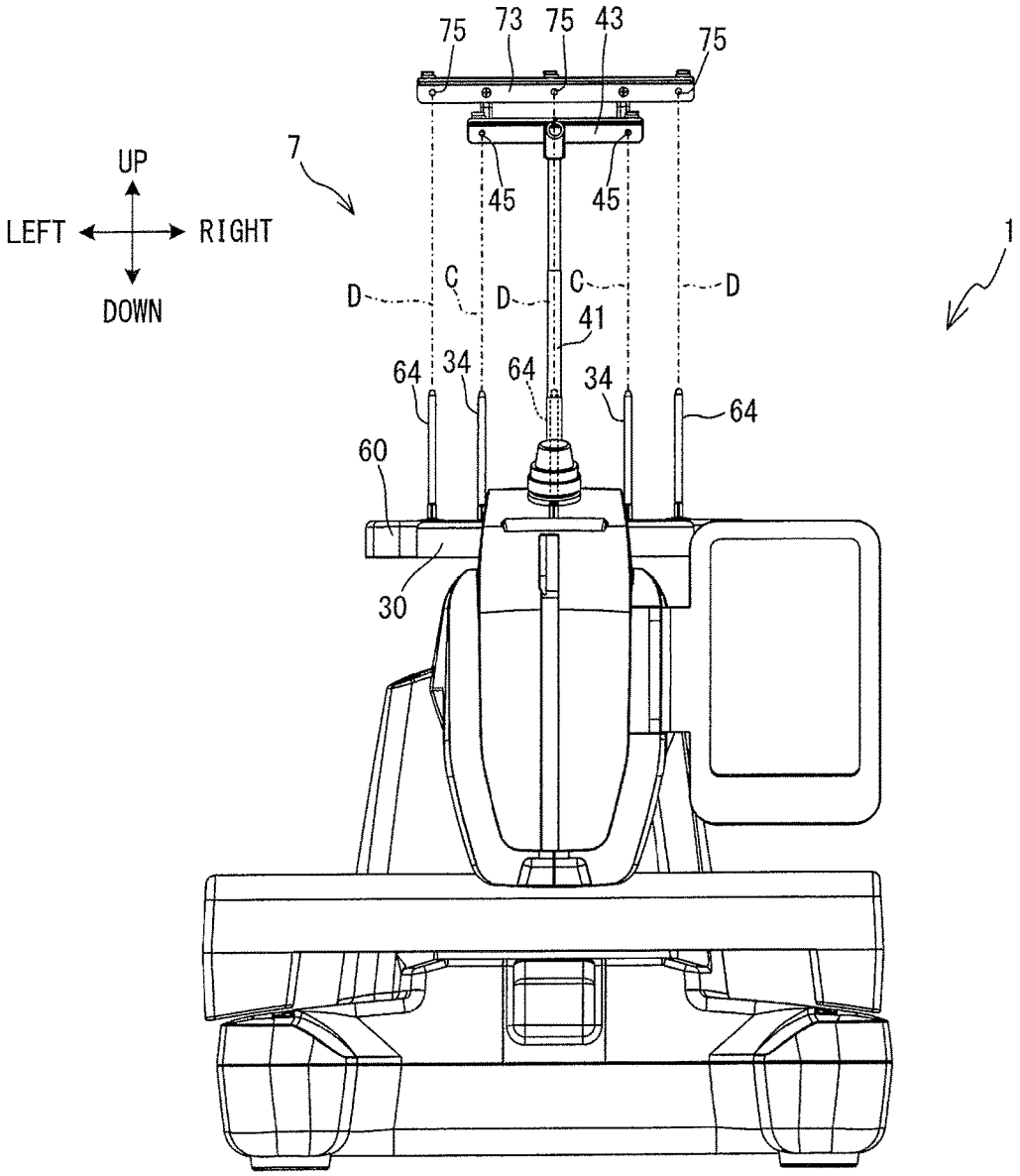
FIG. 13 is a front view of the sewing machine 1.
Figure 14:
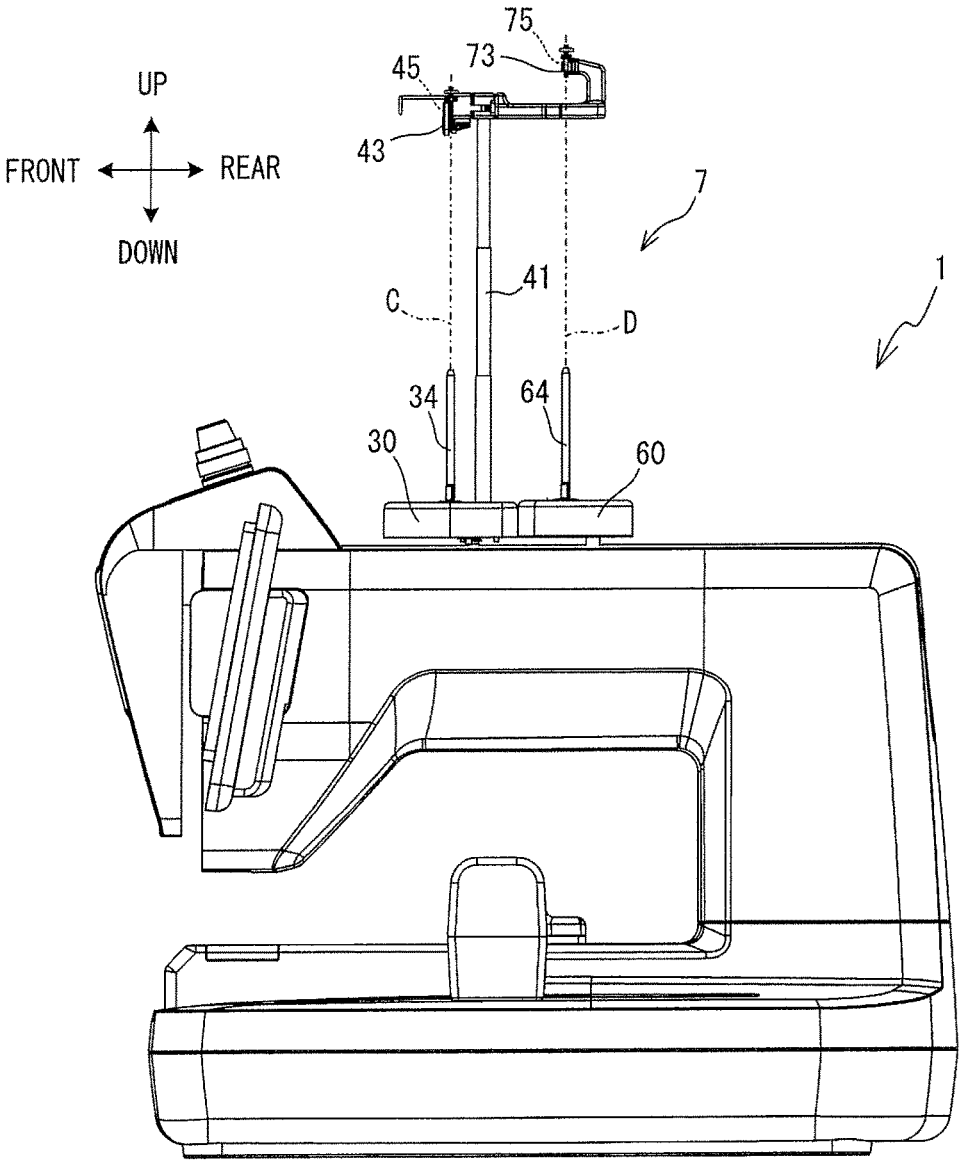
FIG. 14 is a view of a right-side surface of the sewing machine 1.

As described above, the two left and right thread guard holes 45 of the guide member 40 are respectively provided so as to correspond to the two thread spool pins 34 of the thread spool base 30. Further, in a state in which the thread spool base 30 is connected to the thread spool base 60 and the guide member 40 is connected to the guide member 70, the three thread guard holes 75 of the guide member 70 are respectively provided so as to correspond to the three thread spool pins 64 of the thread spool base 60. As shown in FIG. 13 and FIG. 14, the two thread guard holes 45 are respectively disposed substantially on extension lines of center lines of the corresponding thread spool pins 34 (shown as an alternate long and short dash line C) and at positions separate from the thread spool pins 34. Similarly, the three thread guard holes 75 are respectively disposed substantially on extension lines of center lines of the corresponding thread spool pins 64 (shown as an alternate long and short dash line D) and at positions separate from the thread spool pins 64. The position substantially on the extension line is defined herein as a position located inside a virtual cylinder, having a predetermined diameter, a central axis of which is aligned with the extension line of the center line of each of the thread spool pins 34 and 64. The predetermined diameter is a diameter of the thread spool 13, for example. As a result of the thread guard holes 45 and 75 being respectively disposed substantially on the extension lines of the center lines of the corresponding thread spool pins 34 and 64, the needle thread 15 that is wound around the thread spool 13 can be delivered smoothly. It is more preferable that hole centers of the thread guard holes 45 and 75 be positioned on the extension lines of the center lines of the thread spool pins 34 and 64.

The two thread guard holes 45 of the guide member 40 are respectively formed in the guide arm 43 that is fixed, via the arm support 42, to the support pillar 41 that is vertically arranged in the thread spool base 30. More specifically, positions of the two thread guard holes 45 and of the thread spool pins 34 corresponding to the respective thread guard holes 45 are mutually determined with respect to the thread spool base 30, respectively. Thus, in the present embodiment, it is possible to position the two thread guard holes 45 on the extension lines of the center lines of the thread spool pins 34 corresponding to the respective thread guard holes 45. Further, the three thread guard holes 75 of the guide member 70 are respectively formed in the guide arm 73 that is fixed to the arm support 72 that is engaged with the arm support 42. As a result of the arm support 42 and the arm support 72 being engaged with each other, positions of the respective thread guard holes 75 are determined with respect to the thread spool base 30 via the support pillar 41. Further, as the thread spool base 60 is directly engaged with the thread spool base 30, positions of the three thread spool pins 64 are determined with respect to the thread spool base 30. As a result, the positions of the three thread guard holes 75 and of the thread spool pins 64 corresponding to the respective thread guard holes 75 are mutually determined with respect to the thread spool base 30. Thus, in the present embodiment, it is possible to position the three thread guard holes 75 on the extension lines of the center lines of the thread spool pins 64 corresponding to the respective thread guard holes 75.

The thread spools 13 can be mounted on the thread spool bases 30 and 60 by inserting the thread spool pins 34 and 64 into the through holes 14 of the thread spools 13. The needle thread 15 that is delivered from the thread spool 13 is caused to pass through the thread guard holes 45 and 75 that correspond to the thread spool pins 34 and 64 from the rear side to the front side and is then guided to the sewing needle (not shown in the drawings) via the circular portion 48. When replacing the needle thread 15, firstly, the needle thread 15 is removed from the circular portion 48. Then, the needle thread 15 is sandwiched between the lower surface of the O-ring 47 positioned above the thread guard hole 45 corresponding to the needle thread 15 and the upper surface of the guide arm 43 or between the lower surface of the O-ring 77 positioned above the thread guard hole 75 corresponding to the needle thread 15 and the upper surface of the guide arm 73. Then, an end of the needle thread 15 is pulled by hand and cut using the cutting blade 58 of the cutting member 56. The end of the needle thread 15 that has been cut is held by the elasticity of the O-rings 47 and 77. In this manner, the thread spool bases 30 and 60 can hold the end of the needle thread 15 of the thread spool 13 that is not used for the sewing operation. As described above, the end of the needle thread 15 is held by the O-rings 47 and 77. However, it is not limited to the end of the needle thread 15, and it is sufficient if at least a part of the needle thread 15 is held by the O-rings 47 and 77.

The thread spool base 60 can be easily removed from the thread spool base 30 by releasing the engagement between the engaging portions 38 and the engaging portions 68. An upper surface of the bulging portion 68D inclines forward and downward. Thus, in a state in which the bulging portion 68D abuts against the bottom surface of the rear wall of the thread spool base 30 inside the hole portion 39, when a sufficient external force to cause the upper end of the latch portion 68C to bend is further applied, the bulging portion 68D can climb over the rear surface 37. In that state, as a result of the latch portion 68C moving upward with respect to the hole portion 39, the engaging portions 68 of the thread spool base 60 can be disengaged from the engaging portions 38 of the thread spool base 30.

Similarly, the guide member 70 can be easily removed from the guide member 40 by releasing the engagement between the engaging portion 51 and the engaging portion 81. When rear ends of the pair of flexible arms 54 are pressed in a direction that causes the rear ends of the flexible arms 54 to come closer to each other in the left-right direction, the rear ends of the pair of spring pieces 83, which abut against the rear ends of the flexible arms 54, are bent in a direction that causes the rear ends of the spring pieces 83 to come closer to each other in the left-right direction. When a length between the rear ends of the pair of spring pieces 83 becomes shorter than a length between the pair of locking pieces 55, the rear ends of the spring pieces 83 are moved to a section between the locking pieces 55. Side surfaces of the spring pieces 83 incline rearward and outward in the left-right direction. Thus, when the rear ends of the flexible arms 54 are further pressed in the direction that causes the flexible arms 54 to come closer to each other in the left-right direction, the rear ends of the flexible arms 54 slide on the side surfaces of the spring pieces 83 and press the spring pieces 83 in the rear direction. As a result of the support protrusion 82 moving rearward with respect to the hole portion 52, the engaging portion 81 of the guide member 70 can be disengaged from the engaging portion 51 of the guide member 40.

As described above, when the number of thread spools 13 necessary for the sewing operation is small, the user can remove the thread spool base 60 from the thread spool base 30 and can use the sewing machine 1 in a state in which the thread spools 13 are mounted only on the thread spool base 30. Thus, it is possible to reduce an installation space for the sewing machine 1. Further, when the number of thread spools 13 necessary for the sewing operation is large, the user can attach the thread spool base 60 to the thread spool base 30 and can use the sewing machine 1 in a state in which the thread spools 13 are mounted on the thread spool base 30 and the thread spool base 60.

Further, the thread guard holes 45 and the thread guard holes 75 are respectively positioned substantially on the extension lines of the center lines of the thread spool pins 34 and the thread spool pins 64. Thus, the needle thread 15 that is wound around the thread spool 13 can be delivered smoothly toward the thread guard hole 45 or the thread guard hole 75.

As the guide member 40 is provided in the thread spool base 30, positions of the thread spool pins 34 and the thread guard holes 45 are mutually determined. Thus, the thread guard holes 45 can be reliably positioned substantially on the extension lines of the center lines of the thread spool pins 34. As a result of the thread spool base 60 being attached to the thread spool base 30 and the guide member 70 being attached to the guide member 40, the positions of the thread spool pins 64 and the thread guard holes 75 can be determined. Thus, when the thread spool base 60 is attached to the thread spool base 30 and the guide member 70 is attached to the guide member 40, the thread guard holes 75 can be reliably positioned substantially on the extension lines of the center lines of the thread spool pins 64.

The thread spool base 60 can be easily attached to the thread spool base 30 by inserting the protruding portions 68B into the hole portions 39 so as to cause them to be engaged. Further, by simply pulling the protruding portions 68B out of the hole portions 39, it is possible to disengage and remove the thread spool base 60 from the thread spool base 30. Similarly, the guide member 70 can be easily attached to the guide member 40 by inserting the support protrusion 82 into the hole portion 52 so as to cause them to be engaged. Further, by simply pulling the support protrusion 82 out of the hole portion 52, it is possible to disengage and remove the guide member 70 from the guide member 40.

The O-rings 47 and the O-rings 77 can respectively inhibit the needle thread 15 that is not used for the sewing operation from being delivered from the thread spool 13 by holding the end of the needle thread 15.

It is possible to inhibit the needle thread 15 that is used for the sewing operation from being entangled with the needle thread 15 that is not used for the sewing operation by causing the cutting member 56 to cut the needle thread 15 that is not used for the sewing operation so as to make the end of the needle thread 15 short.

Figure 15:
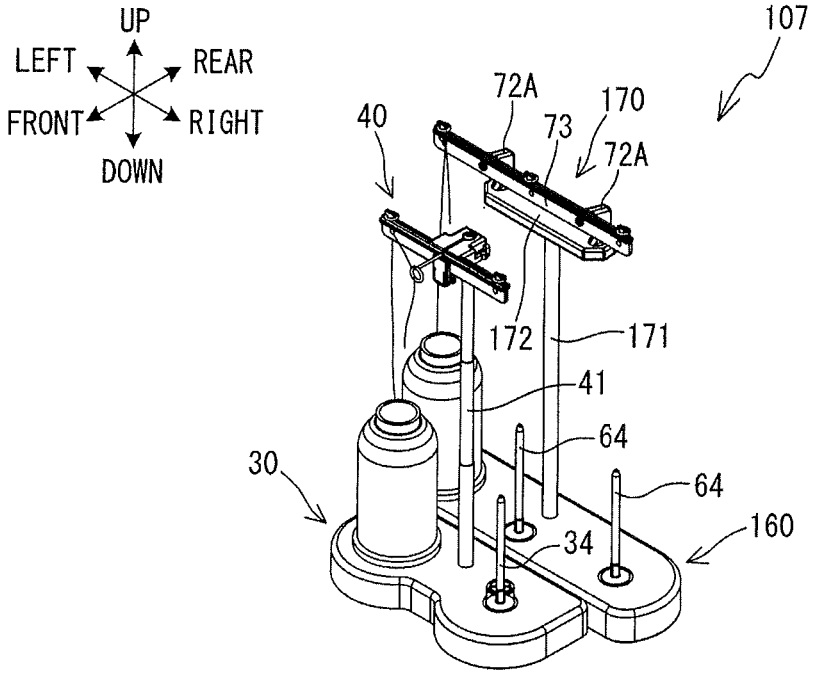
FIG. 15 is a perspective view of a thread spool portion 107.

Various modifications can be made to the above-described embodiment. For example, as with a thread spool portion 107 shown in FIG. 15, it is acceptable to have a configuration in which the guide member 40 and a guide member 170 are not engaged with each other. In this case, a support pillar 171 is provided on an upper surface 161 of a thread spool base 160. The support pillar 171 is longer than the support pillar 41 in the up-down direction. An arm support 172 that extends in the left-right direction is fixed to an upper end of the support pillar 171. The guide arm 73 is fixed to the arm support portions 72A that are provided at both ends of the arm support 172. The engagement between the thread spool base 30 and the thread spool base 160 is similar to that of the present embodiment. The positions of the three thread guard holes 75 and of the thread spool pins 64 corresponding to the respective thread guard holes 75 are mutually determined with respect to the thread spool base 160 by the support pillar 171. Thus, the three thread guard holes 75 can be respectively positioned on the extension lines of the center lines of the thread spool pins 64 that correspond to the respective thread guard holes 75.

The number of the thread spool pins 34 of the thread spool base 30 is not limited to two and may be one, or may be three or more. The number of the thread spool pins 64 of the thread spool base 60 is not limited to three and may be one, two, or four or more. In these cases, the number of the thread guard holes 45 and 75 are provided so as to correspond to the number of the thread spool pins 34 and 64, respectively.

Figure 16:
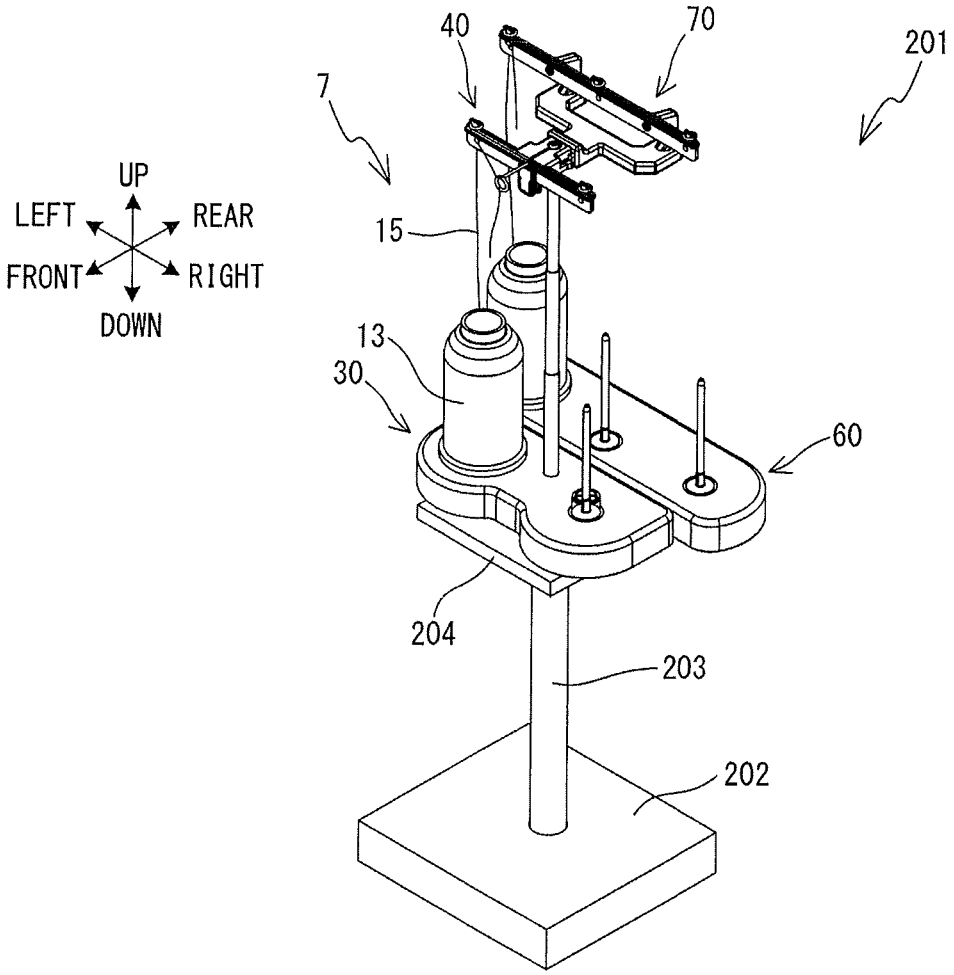
FIG. 16 is a perspective view of a thread spool device 201.

Further, as in a thread spool device 201 shown in FIG. 16, the thread spool portion 7 of the present embodiment may be provided independently from the sewing machine 1, in which the needle thread 15 is supplied from the thread spool 13 to the sewing machine 1. In this case, the thread spool device 201 can generate the effect achieved by the sewing machine 1. In the thread spool portion 7, the thread spool base 30 is fixed on an upper surface of a plate-shaped fixing base 204 that is provided on an upper end portion of a supporting rod 203 vertically arranged on a pedestal-shaped base portion 202, for example. In a similar manner to the present embodiment, by engaging with the thread spool base 30 and the guide member 40, the thread spool base 60 and the guide member 70 may be configured to be capable of being attached to the thread spool base 30 and the guide member 40, respectively. Needless to say, the above-described thread spool portion 107 may be applied to the thread spool device 201, and the positions of the thread guard holes 75 and the thread spool pins 64 may be determined with respect to the thread spool base 160.

What is claimed is:

1. A sewing machine comprising:

a first thread spool base that is configured such that a thread spool is mounted thereon, the first thread spool base having a box-shape that has an upper surface and a rear surface;

a first engaging portion that is provided on the rear surface of the first thread spool base;

a first thread spool pin that is provided on the first thread spool base and is configured to be inserted into a through hole of the thread spool mounted on the first thread spool base, the first thread spool pin extending upward from the upper surface of the first thread spool base;

a first guide member that is provided in the first thread spool base and has a first thread guard portion, the first thread guard portion being configured to guide a needle thread delivered from the thread spool mounted on the first thread spool base to the sewing machine;

a second thread spool base that is configured to be capable of being attached to and removed from the first thread spool base and is configured such that a thread spool is mounted thereon, the second thread spool base having a box-shape having an upper surface and a front surface;

a first engaged portion that is provided on the front surface of the second thread spool base, the first engaged portion being capable of being engaged with and disengaged from the first engaging portion in a state in which the front surface of the second thread spool base faces the rear surface of the first thread spool base in front-rear direction;

a second thread spool pin that is provided on the second thread spool base and is configured to be inserted into a through hole of the thread spool mounted on the second thread spool base, the second thread spool pin extending upward from the upper surface of the second thread spool base; and a second guide member that has a second thread guard portion, the second thread guard portion being configured to guide a needle thread delivered from the thread spool mounted on the second thread spool base to the sewing machine.

2. The sewing machine according to claim 1, wherein the second guide member is configured to be capable of being attached to and removed from the first guide member.

3. The sewing machine according to claim 2, wherein when the second thread spool base is attached to the first thread spool base and the second guide member is attached to the first guide member, the second thread guard portion is disposed to correspond to the second thread spool pin at a position that is on an extension line of a center line of the second thread spool pin and that is separated from the second thread spool pin.

4. The sewing machine according to claim 2, wherein the first guide member is provided with a bar-shaped support pillar and a guide portion, the support pillar extending upward, one end side of the support pillar being fixed to the upper surface of the first thread spool base, another end side of the support pillar being fixed to the guide portion, the guide portion including the first thread guard portion, the guide portion of the first guide member is provided with a second engaging portion, and the second guide member is provided with a second engaged portion, the second engaged portion being capable of being engaged with and disengaged from the second engaging portion.

5. The sewing machine according to claim 4, wherein of the first engaging portion and the first engaged portion, one is a protruding portion and the other is a hole portion into which the protruding portion is inserted so as to be engaged therewith.

6. The sewing machine according to claim 1, further comprising:

a first holding member that is provided on the first guide member and is configured to hold the needle thread delivered from the thread spool mounted on the first thread spool base; and a second holding member that is provided on the second guide member and is configured to hold the needle thread delivered from the thread spool mounted on the second thread spool base.

7. The sewing machine according to claim 1, further comprising:

a cutting member that is provided in the first guide member and is configured to cut the needle thread.

8. The sewing machine according to claim 1, further comprising:

an arm that is provided with an engaging hole on an upper surface, wherein the first thread spool base is provided on the upper surface of the arm, and the second thread spool base is provided with a protruding portion, the protruding portion protrudes downward from an lower surface of the second thread spool base and engages with the engaging hole of the arm.

9. A thread spool device comprising:

a first thread spool base that is configured such that a thread spool is mounted thereon, the first thread spool base having a box-shape that has an upper surface and a rear surface;

a first engaging portion that is provided on the rear surface of the first thread spool base;

a first thread spool pin that is provided on the first thread spool base and is configured to be inserted into a through hole of the thread spool mounted on the first thread spool base, the first thread spool pin extending upward from the upper surface of the first thread spool base;

a first guide member that is provided in the first thread spool base and has a first thread guard portion, the first thread guard portion being configured to guide a needle thread delivered from the thread spool mounted on the first thread spool base to the sewing machine;

a second thread spool base that is configured to be capable of being attached to and removed from the first thread spool base and is configured such that a thread spool is mounted thereon, the second thread spool base having a box-shape having an upper surface and a front surface;

a first engaged portion that is provided on the front surface of the second thread spool base, the first engaged portion being capable of being engaged with and disengaged from the first engaging portion in a state in which the front surface of the second thread spool base faces the rear surface of the first thread spool base in front-rear direction;

a second thread spool pin that is provided on the second thread spool base and is configured to be inserted into a through hole of the thread spool mounted on the second thread spool base, the second thread spool pin extending upward from the upper surface of the second thread spool base; and a second guide member that has a second thread guard portion, the second thread guard portion being configured to guide a needle thread delivered from the thread spool mounted on the second thread spool base to the sewing machine.

10. The thread spool device according to claim 9, wherein the second guide member is configured to be capable of being attached to and removed from the first guide member.

11. The thread spool device according to claim 10, wherein when the second thread spool base is attached to the first thread spool base and the second guide member is attached to the first guide member, the second thread guard portion is disposed to correspond to the second thread spool pin at a position that is on an extension line of a center line of the second thread spool pin and that is separated from the second thread spool pin.

12. The thread spool device according to claim 10, wherein the first guide member is provided with a bar-shaped support pillar and a guide portion, the support pillar extending upward, one end side of the support pillar being fixed to the upper surface of the first thread spool base, another end side of the support pillar being fixed to the guide portion, the guide portion including the first thread guard portion, the guide portion of the first guide member is provided with a second engaging portion, and the second guide member is provided with a second engaged portion, the second engaged portion being capable of being engaged with and disengaged from the second engaging portion.

13. The thread spool device according to claim 12, wherein of the first engaging portion and the first engaged portion, one is a protruding portion and the other is a hole portion into which the protruding portion is inserted so as to be engaged therewith.

14. The thread spool device according to claim 9, further comprising:

a first holding member that is provided on the first guide member and is configured to hold the needle thread delivered from the thread spool mounted on the first thread spool base; and a second holding member that is provided on the second guide member and is configured to hold the needle thread delivered from the thread spool mounted on the second thread spool base.

15. The thread spool device according to claim 9, further comprising:

a cutting member that is provided in the first guide member and is configured to cut the needle thread.

* * * * *